United States Patent [19]

Sanford

[11] Patent Number: 4,853,503

[45] Date of Patent: Aug. 1, 1989

[54] PRESSURE SWITCH APPARATUS HAVING IMPROVED LONGEVITY AND WIDENED TOLERANCE FOR LOCATION OF STATIONARY CONTACT

[75] Inventor: Carlton E. Sanford, E. Providence, R.I.

[73] Assignee: Texas Instruments Incorporated, Dallas, Tex.

[21] Appl. No.: 249,214

[22] Filed: Sep. 26, 1988

Related U.S. Application Data

[62] Division of Ser. No. 169,799, Mar. 18, 1988 Pat. No. 4,861,953.

[51] Int. Cl.[4] ..... H01H 35/34

[52] U.S. Cl. ..... 200/83 P; 92/103 M; 200/83 N; 200/302.1; 337/320

[58] Field of Search ..... 200/81.4, 81.5, 83 R, 200/83 A, 83 P, 83 Q, 83 N, 302.1; 337/117, 318, 320, 321; 307/118; 340/626; 92/5 R, 103 M; 73/717, 723, 861.47

*Primary Examiner*—Gerald P. Tolin

*Attorney, Agent, or Firm*—John A. Haug; James P. McAndrews; Melvin Sharp

[57] ABSTRACT

An automotive transmission control is shown having pressure switches to sense the state of actuation of solenoid valves to provide logic signals to a microprocessor type of transmission control. The pressure switches, which sense the pressure of hydraulic fluid controlled by the solenoid valves, use a dished shaped metallic diaphragm characterized in that the pressure-deflection curve of the center of the diaphragm has minimal hysteresis and reflects that the diaphragm is relatively stiff having a positive coefficient of pressure with increasing deflection up to and above a selected pressure level at which level the center accelerates between $d_1$ and $d_2$. The diaphragm is loosely held on a conductor at 0 psig with the fluid pressure when it increases forcing the diaphragm into sealing and electrical engagement with the conductor.

8 Claims, 4 Drawing Sheets

PRESSURE SWITCH APPARATUS HAVING IMPROVED LONGEVITY AND WIDENED TOLERANCE FOR LOCATION OF STATIONARY CONTACT

This application is a division, of application Ser. No. 169,799, filed 3/18/88.

This invention relates generally to pressure switches and more particularly to such switches especially suitable for use with computerized controls requiring a device longevity measured in the million of switch cycles.

In the automotive industry it has become common to control various functions such as air-fuel mixtures by means of a microprocessor based engine control module (ECM) to obtain significant improvements in performance, fuel economy and emissions. Recently these functions have been expanded to include the operation of transmission systems by integrating engine and transmission control. This requires that the transmission be compatible with the ECM and be electronicaly accessible with inputs and outputs. One approach in which solenoid valves are employed to effect gear shifting uses pressure switches in the solenoid valve assembly as a way to confirm that solenoid valve actuation and deactuation has occurred. That is, there is a noticeable change in the pressure of the hydraulic fluid in the output of a solenoid valve upon actuation, typically in the order of 165 psig. This change in pressure can be easily sensed using conventional snap acting pressure responsive switches which can close or open electrical circuits on the occurrence of selected pressure levels. Such switches can be readily adapted to meet varying packaging requirements regarding size and cost. However when used for transmission control, a life expectancy in the order of 25 million cycles or more is required whereas conventional snap acting pressure switches have a life expectancy significantly lower than that, in the order of a million cycles at best.

In copending application, Ser. No. 903,328 filed Sept. 3, 1986 and assigned to the assignee of the instant application Pat No. 4,758,695, an automotive transmission control system is disclosed in which a metallic diaphragm is used having significantly improved longevity compared to prior art devices. The diaphragms having such improved longevity are formed with a central dished portion having a pressure deflection relationship such that the diaphragm is relatively stiff having a positive coefficient of pressure with increasing deflection up to an above a relative narrow range of set points or calibrated pressures. Within the range of set points the effective spring rate of the diaphragm is relatively supple with only a small increase in pressure resulting in relatively larger travel of the center of the diaphragm. The diaphragms are also characterized in having significantly less hysteresis than conventional snap acting discs to minimize the build up of stresses in the diaphragm since these stresses serve to limit the longevity of the diaphragm. Among the embodiments disclosed are switches in which the diaphragms are formed with an annular flat berm portion which is received on an electrical contact member with an "O"-ring disposed on top of the berm and biased thereagainst to form a fluid pressure seal by a tubular sleeve which communicates with a hydraulic fluid pressure source. Another embodiment provides a sleeve formed in two segments with the "O" ring sandwiched therebetween so that the sleeve itself engages the berm portion.

An electrical contact rivet is placed beneath the central dished portion and connected to a suitable electrical connector. While the berm provides a convenient way to mount and seal the diaphragm, the integral interconnection between the flat berm portion and the central dished portion results in limiting the life of the diaphragm. In other embodiments the entire diaphragm is dished and maintained on the electrical contact member by means of a thin flexible membrane which also provides a seal for the switch. However, the use of a membrane to retain the diaphragms in their respective seats limits the positioning of the stationary center contact to the low pressure side of the diaphragm (to close a circuit upon pressure increase). That is, the membrane would preclude the use of a fixed contact on the high pressure side of this diaphragm (to open a circuit upon selected pressure increase).

It is therefor an object of the invention to provide a switch with an improved extremely long life expectancy. Another object is the provision of a switch which is economical to produce both in material and assembly. Another object is to provide a switch which needs no calibration as an assembly, the calibration of the switch being inherently controlled by the characteristics of the diaphragm yet has relatively wide tolerance for locating the stationary contact Yet another object is the provision of a pressure responsive switch having a life expectancy in excess of 25 million cycles, an operating temperature range of −40° to 300° F. and a cycling response capability of up to 50 Hz. Another object of the invention is the provision of a switch mechanism with minimal set point differential of hysteresis and one which can be made to actuate at a given level of pressure within plus or minus 5 psi. Yet another object is the provision of a diaphragm which during normal operation will actuate at a selected relatively low pressure level, e.g. 22 psig, yet withstand pressure levels of up to approximately 165 psig without deleterious effects. Other objects, features and advantages of the invention will be apparent from the following detailed disclosure, taken in conjunction with the accompanying drawings, wherein like reference numerals refer to like parts.

Briefly these and other objects are attained by forming the entire surface of the diaphragm into a dished configuration with the center of the diaphragm having a pressure versus deflection relationship such that for increasing pressure from 0 psig up to and beyond a plateau having a range of deflections between $d_1$ and $d_2$ the diaphragm has a relatively stiff effective spring rate with the center deflecting between $d_1$ and $d_2$ at essentially the same pressure level, the diaphragm also having a relatively narrow differential between the pressure at which the center of the diaphragm deflects between $d_1$ and $d_2$ on increasing pressure and the pressure at which it deflects between $d_2$ and $d_1$ on decreasing pressure.

According to a feature of the invention the diaphragm is retained in the switch housing on an electrical contact member by a cylindrical sleeve disposed thereon. The sleeve is formed with a recess at an end thereof adapted to capture the outer periphery of the diaphragm. The depth of the recess is greater than the thickness of the diaphragm so that the diaphragm is loosely maintained on its seat.

According to another feature of the invention a stationary contact is disposed beneath the center of the diaphragm and is formed with a circular flanged head countersunk in the bottom wall of the housing under the diaphragm to form with the bottom wall a smooth support surface and placed, relative to the diaphragm, to limit overtravel and buckling of the diaphragm with concomitant stresses. The stationary contact is formed with an upwardly facing convex surface having a relatively small radius to provide an initial small area of contact with the diaphram for the purpose of providing a relatively high unit force for reliable electrical commutation. This small radiused center section of the stationary contact projects above a flat berm area of the contact only high enough the assure initial contact with the diaphragm, the projection being in the order of 0.0015 inch, additional movement of the diaphragm is supported by the flat berm area of the contact to limit excessive overtravel with attendent increased stresses in the diaphragm.

According to a feature of the invention the stationary contact can be located anywhere between $d_1$ and $d_2$ relative to a plane on which the diaphragm lies and still serve to close a circuit with the diaphragm at the same pressure due to the plateau of the pressure versus deflection curve existing between $d_1$ and $d_2$. Preferably the stationary contact is disposed closer to $d_1$ to allow for contact wear and provide greater cycle life for switching at the same pressure.

Figure 1:
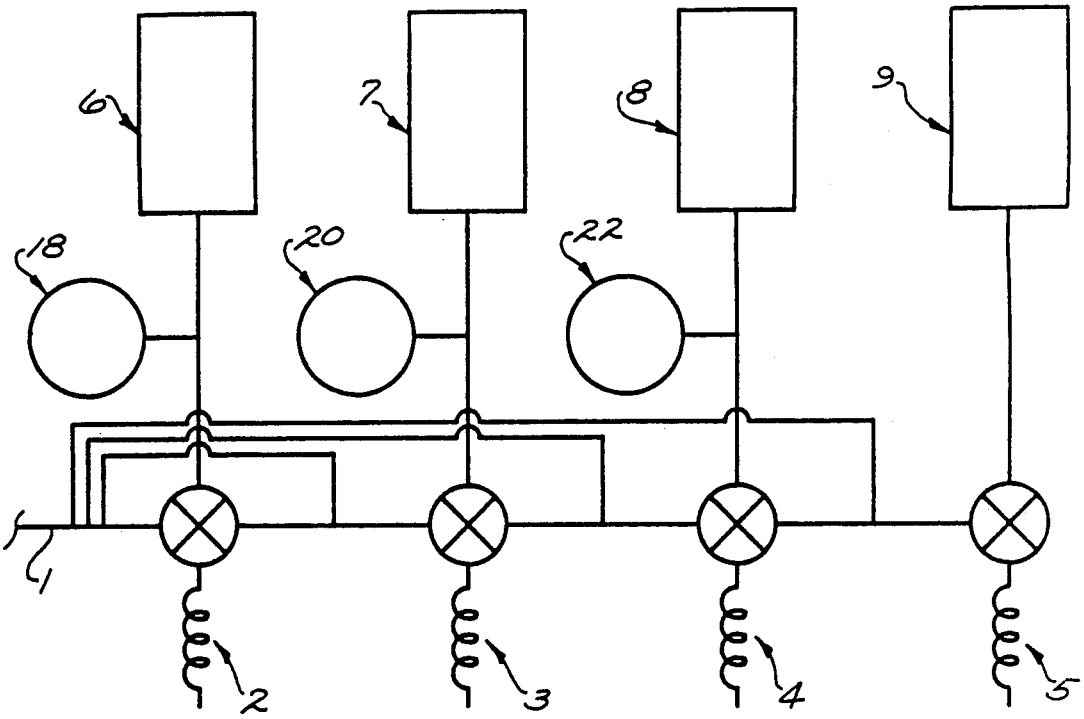
FIG. 1 is a schematic representation of a transmission control assembly in which pressure switches made in accordance with the invention are used.
Figure 2:
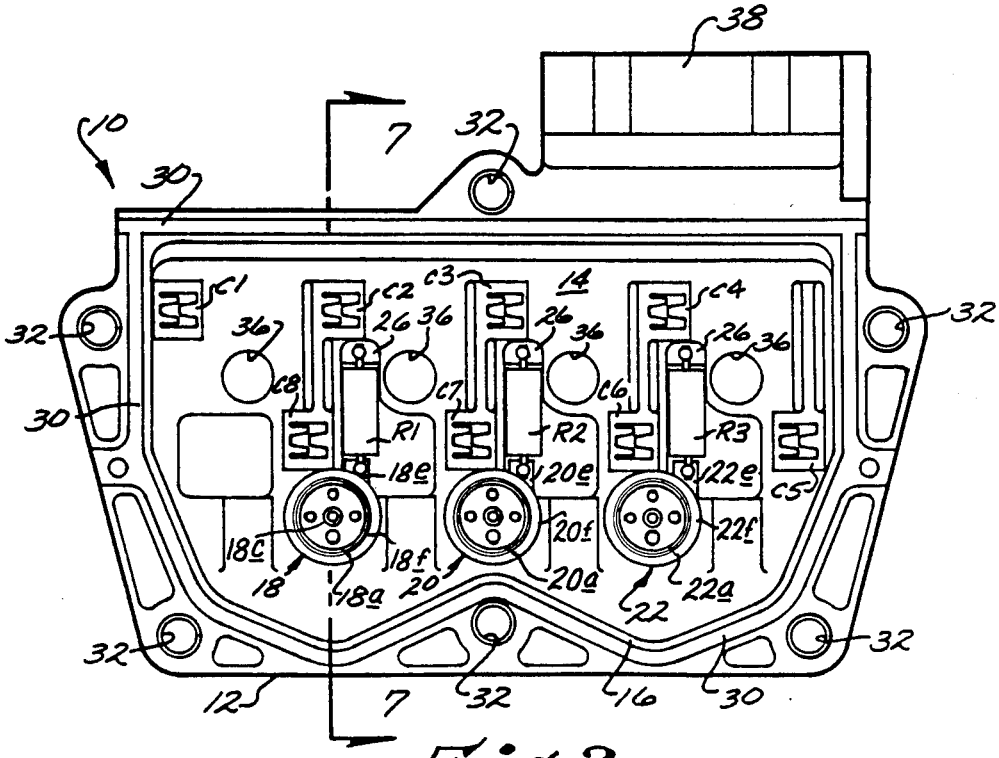
FIG. 2 is a front elevational view of pressure switch assembly made in accordance with the invention showing three switch stations but, for purposes of illustration having the pressure sensing diaphragms removed.

Referring to FIG. 1 of the drawings in which a proposed transmission control assembly is shown, numeral 1 indicates an hydraulic fluid pressure source connected to solenoid actuated valves 2, 3, 4 and 5 to control respectively friction elements 6, 7, 8 and 9. Pressure sensing switches 18, 20 and 22 are placed in communication with the output line of respective solenoid actuated valves 2, 3 and 4. The valves may be normally vented and/or normally pressurized with the state of actuation sensed by the pressure switches. For example, when a valve is actuated placing its output line in communication with the hydraulic fluid pressure source 1, the pressure at the pressure sensor ramps up from approximately 0 psig to 165 psig. This change in pressure, as will be described infra, is converted to an electrical signal which can be inputted to the microprocessor to confirm that actuation or deactuation of a respective valve has taken place.

Figure 3:
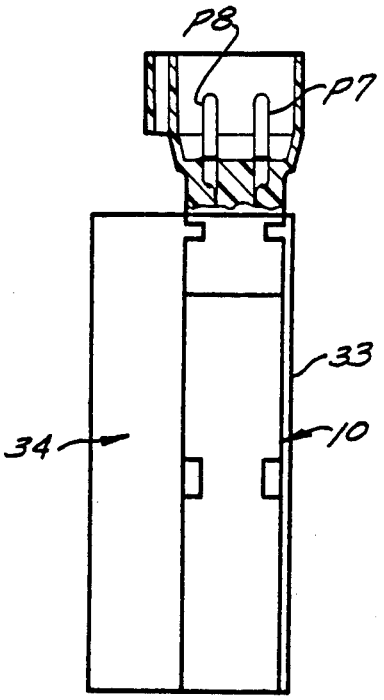
FIG. 3 is a side elevational view of the FIG. 2 assembly with a connector portion shown in cross section and shown attached to a solenoid assembly with a back plate attached.
Figure 4:
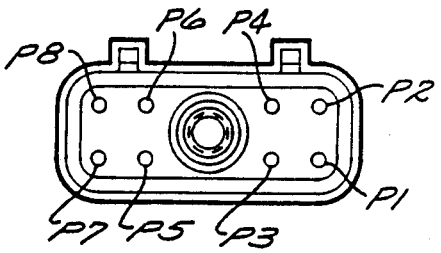
FIG. 4 is a top plan view of the connector portion of the switch assembly.
Figure 5:
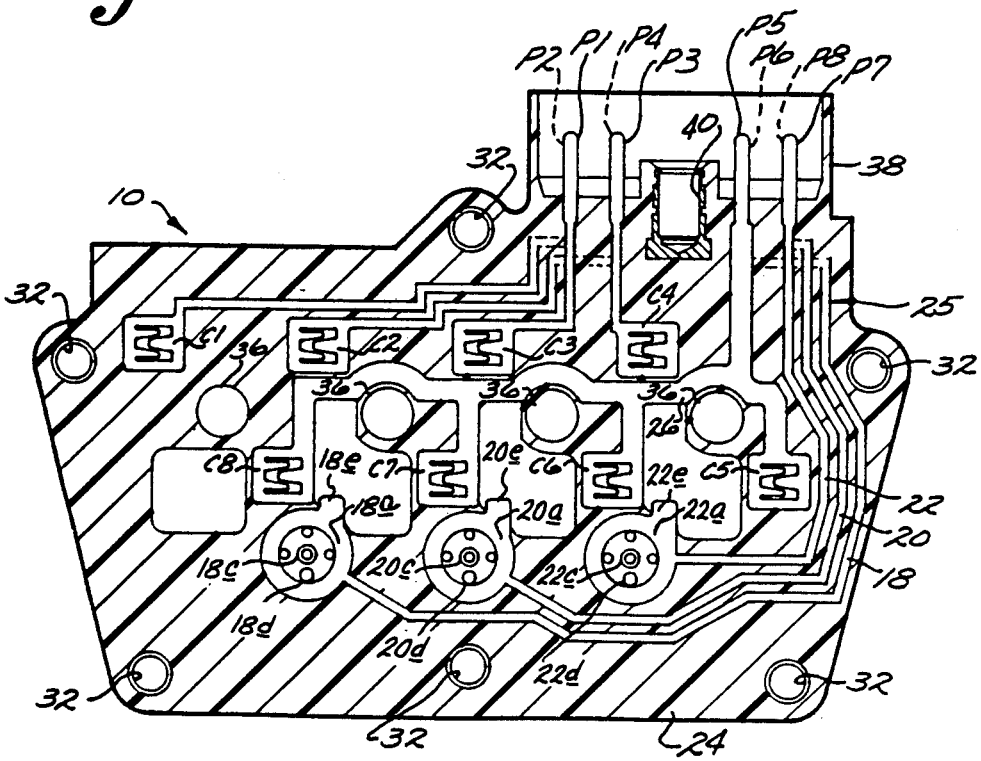
FIG. 5 is a cross sectional view taken on line 5—5 of FIG. 7 showing a pattern of electrically conductive paths molded into the assembly housing.

With particular reference to FIGS. 2–8, Numeral 10 generally designates a switch assembly comprising a housing 12 of suitable electrically insulative material such as a moldable glass filled thermoplastic material having a back wall 14 and a side wall 16 depending therefrom defining a shallow recess in which are disposed three pressure switch stations 18, 20 and 22. Housing 12 is preferably formed with the desired electrical conductors molded therein. As seen in FIG. 5, the plane 24 formed by the cross section shows conductive paths 25 disposed thereon in a selected pattern. The pattern is conveniently stamped from a suitable metal sheet such as brass with portions of the pattern blanked out after the molding operation through apertures (not shown) formed in back wall 14 for the purpose of isolating respective circuits. It will be understood that the housing could also be made of two plate like members with the conductive paths 25 sandwiched therebetween or the paths could be coated onto one of the plate members, if desired. The paths include annular portions **18*a*, 20*a* and 22*a* located at the switch stations including respective platform portions 18*e*, 20*e*, and 22*e* the purpose of which will be described infra, with traces 18*b*, 20*b* and 22*b* extending from respective annular portions to respective pins P6, P8 and P7. Pins P2, P4, P6 and P8 are not shown in FIG. 5 but are indicated by dashed lead lines since they are located in the front half of the housing. FIG. 4 shows the layout of pins P1–P8. Pin P5 is connected to a conductive trace 26 which extends to a plurality of spring connectors C5–C8. Pin P3 extends to spring connector C4, pin P4 extends to connector C2, pin P1 extends to spring connector C3 and finally pin P2 extends to spring connector C1**.

Within the space defined by each annular conductive layer **18*a*, 20*a* and 22*a* are a center contact bore 18*c*, 20*c* and 22*c* respectively and a plurality of vent holes 18*d*, 20*d* and 22*d* which will be described in greater detail infra with respect to FIG. 8**.

Referring back to FIG. 2, back wall 14 is formed with cut away portions to expose contact springs C1–C8, annular conductive portions **18*a*, 20*a* and 22*a* as well as platform portions 18*e*, 20*e* and 22*e* and portions of trace 26 opposed to each platform. Selected resistors R1, R2, and R3 are welded or soldered between respective platform portions 18*e*, 20*e*, 22*e* and opposed portions of trace 26**.

Back wall 14 is formed with a cylindrical wall **18*f*, 20*f* and 22*f* for each respective switch station aligned with respective annular conductors 18*a*, 20*a*, 22*a* to form switching cavities. Side wall 16 is formed with a packing groove 30 around the periphery of the housing and a plurality of bolt holes 32 to attach a back plate 33 (FIG. 3) and to secure the housing to a solenoid valve assembly 34 (FIG. 3). Bores 36 extend through back wall 14 to conserve material and provide venting to a sump. A shroud 38 extends around the pins P1–P8 to isolate them from the environment. A threaded bore 40 is formed in housing 12 within the shroud 38** to secure a female connector (not shown).

Figure 6:
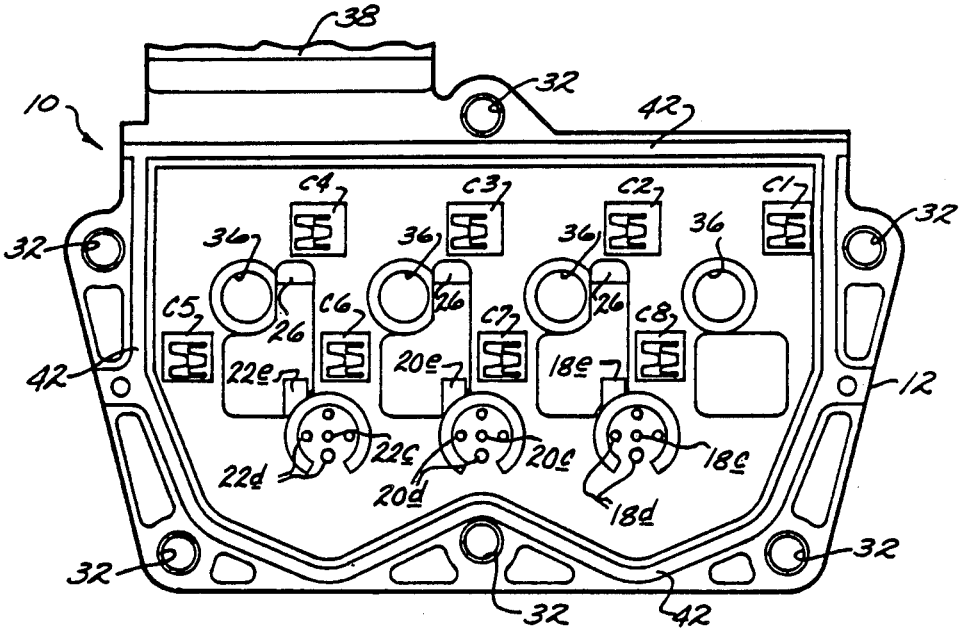
FIG. 6 is a rear elevational view of the switch assembly housing.
Figure 7:
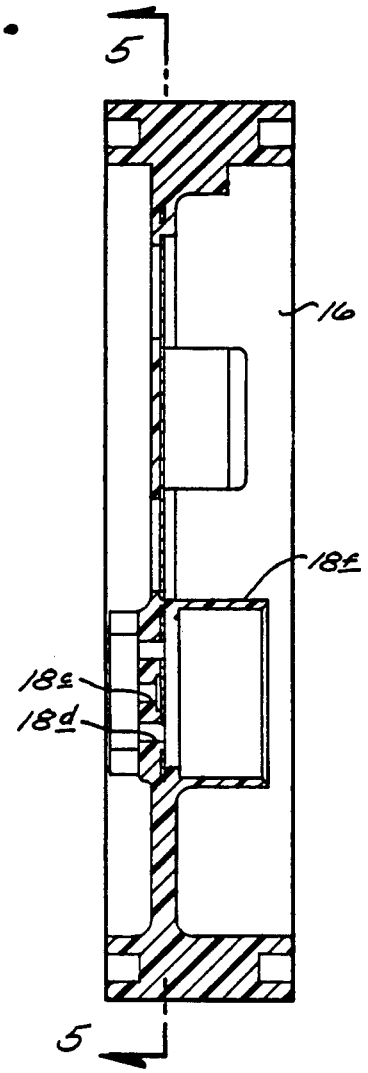
FIG. 7 is an enlarged cross sectional view taken of line 7—7 of FIG. 2.

FIG. 6 shows the rear view of housing 12 with a portion of shroud 38 removed for convenience and shown without resistors R1–R3. A packing groove 42 is formed around the perimeter of platform 24 similar to that of groove 30 shown in FIG. 2.

Figure 8:
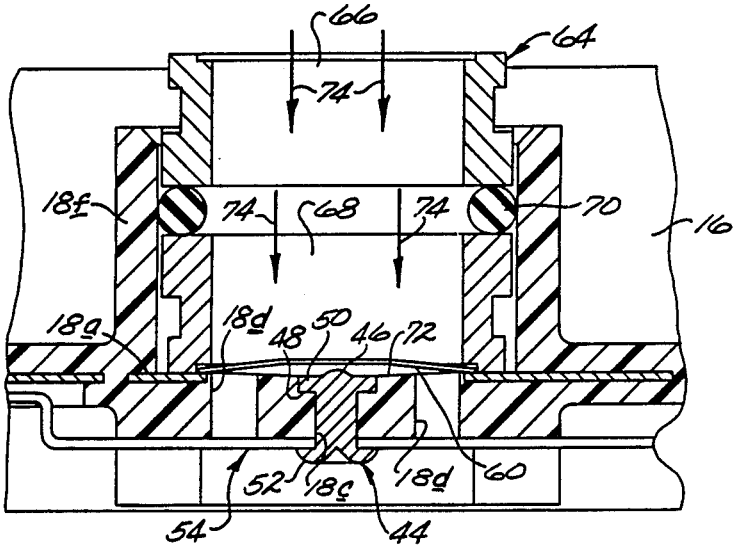
FIG. 8 is an enlarged cross sectional view taken through a switching station shown with the diaphragm retained at its seat on an electrical contact member.
Figure 9:
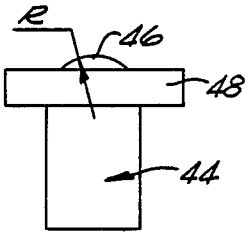
FIG. 9 is an enlarged side view of a rivet prior to its insertion in the switch housing for use as an electrically conductive center contact.

With particular reference to FIGS. 8 and 9 one of the switch stations will be described. An electrically conductive rivet 44 is received in bore 18*c* and has one end 46 disposed along the longitudinal axis of the rivet a selected distance from a plane lying on the top surface (as seen in FIG. 8) of the annular portion of conductor 18*a* and serves as a center contact for the switch. As will be explained infra, due to the platform portion of the pressure versus deflection curve between $d_1$ and $d_2$ the precise location of end 46 need only be between these points for the switch to close at the selected pressure level so that a molded countersunk portion 48 contiguous to bore 18*c* can conveniently be used in conjunction with circular flanged head 50 to determine that location. That is, the other end 52 of rivet 44 is headed over with end 46 being brought down, relative to the plane on the top surface of the annular portion, to the specific point on the deflection curve desired to complete calibration of the switch.

End 52 of rivet 44 is also headed over into electrical and physical engagement with a bus bar 54 formed of conventional good electrically conductive material.

A generally circular diaphragm 60 formed of electrically conductive metal having good spring characteristics such as stainless steel is formed with a diameter slightly greater than the inside diameter of the annular portion of conductor 18a so that it can be seated thereon. The diaphragm is deformed beyond its elastic limit with the center of the diaphragm displaced so that it has a slightly dished configuration and with a pressure versus deflection relationship to be explained infra. The diaphragm is disposed on conductor 18a with the face having a convex configuration facing away from rivet 44.

Diaphragm 60 is retained on its seat by a cylindrical sleeve assembly 64 telescopically and slidably received within cylindrical wall 18*f*. Sleeve assembly 64 preferably comprises first and second segments 66, 68 formed of brass or other suitable material with an "O" ring 70 sandwiched therebetween. Sleeve segment 68 avoids any lateral forces exerted on segment 66 from being transmitted to the diaphragm while "O" ring 70 electrically isolates segment 66 from the diaphragm. In FIG. 8, the sleeve, extends beyond wall 16 a slight amount. When the solenoid module is attached to housing 12 as indicated in FIG. 3, a force will be placed on the sleeve to bias it firmly toward the "O" ring. With the solenoid module attached to housing 12 sleeve 64 of switching station 18 is placed in communication with a pressure source used to actuate the transmission solenoid valves. Switching stations 20 and 22 are similarly coupled to other transmission solenoid valves.

The bottom end of sleeve segment 68 is formed with an annular recess in communication with the interior of the sleeve, the recess having a depth along the longitudinal axis of the sleeve segment somewhat greater than the thickness of the diaphragm. The recess has a diameter large enough to loosely receive a diaphragm so that it is free to move up and down within the recess but is restrained from lateral motion and accurately maintained centered over rivet 44. Thus there are no stresses placed on the diaphragm in mounting it on its seat.

The bottom or back wall 14 of the housing is formed with a tapered recess 72 extending from countersunk portion 50 up to the inner diameter of the annular portion of conductor 18*a* forming a smooth continuous support surface along with circular flanged head 50 to prevent overtravel of the diaphragm and buckling of the central portion of the diaphragm which would induce stresses therein and limit its useful life. Bores 18*d* are disposed adjacent the outer periphery of the diaphragm and are sufficiently small in diameter that they do not cause any buckling in the diaphragm.

Head 46 is formed with a central radius and surrounding berm to decrease the initial area of engagement and to evenly distribute stresses in the diaphragm. The need for the shaped, continuous support surface for the central portion of the diaphragm is accentuated because of the high pressure to which the diaphragm is subjected in normal operation. That is, the diaphragm is formed so that it moves into engagement with the rivet at a pressure level in the order of 22 psig and, as mentioned supra, that pressure quickly ramps up to approximately 165 psig and yet the system requirement is for the diaphragm to have a life expectancy in excess of 28 million cycles.

In hydraulic systems of the type described with relatively large pump outputs, a small amount of leakage can be tolerated in the switch unit without any substantial effect on the system performance or the ability of the diaphragm to sense and respond to system pressure changes.

In the FIG. 8 arrangement where diaphragm 60 is loosely held in place on conductor 18*a* by cylindrical retainer 68 at 0 psig fluid pressure as noted by arrows 74 forces the diaphragm against conductor 18*a*. Any fluid which may leak between diaphragm 60 and conductor 18*a* is miniscule and has no substantial affect on the rate of pressure increase in the system or the pressure level at which where the diaphragm will move into engagement with the stationary contact, rivet 44.

This arrangement eliminates the need for a flexible membrane to seal, position and retain the diaphragm in place. Further, in the absence of a membrane the convex face of the diaphragm can be used to electrically engage a stationary contact disposed on the high pressure side of the diaphragm for a normally closed switching function should it be desired.

As noted supra, forming of the diaphragm 60 with a dished configuration results in a non linear pressure versus diaphragm center point displacement. It has been found that by controlling the amount that the diaphragm is dished it is possible to obtain a pressure versus deflection relationship such that the center, while gradually deflecting with increasing pressure will accelerate at a particular pressure from $d_1$ to $d_2$ and will then revert to gradual deflection with further increases in pressure and that this can be achieved with a narrow differential. Differential or hysteresis refers to the difference between actuated pressure (increasing pressure) and deactuation pressure (decreasing pressure). The amount of stresses built into the diaphragm to produce the acceleration is far less than that which is produced in conventional snap acting discs which have a significant negative slope in their pressure versus deflection relationship and which makes such discs unsuitable for applications calling for a minimum life expectancy in the millions of cycles.

Figure 10:
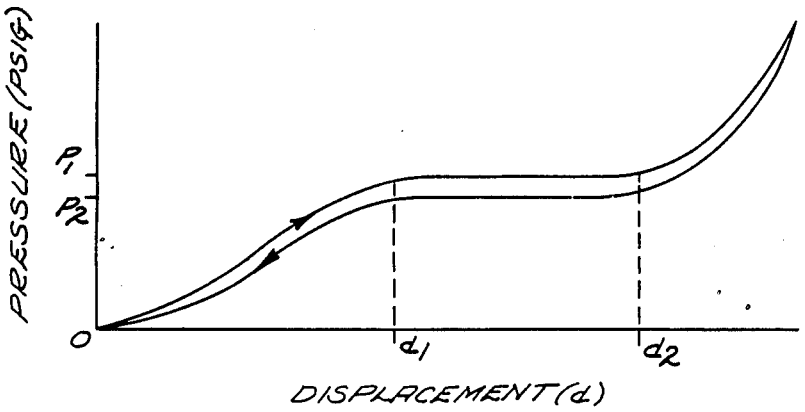
FIG. 10 is a pressure versus displacement graph of a diaphragm made in accordance with the invention.

As seen in FIG. 10 which is an actual trace of a typical diaphragm made in accordance with the invention for pressure versus displacement the diaphragm has, for increasing pressure from 0 psig up to and beyond a plateau having a range of deflection between $d_1$ and $d_2$, a relatively stiff effective spring rate with the center deflecting between $d_1$ and $d_2$ at essentially the same pressure level. The diaphragm also has a relatively narrow differential between the pressure at which the center of the diaphragm deflects between $d_1$ and $d_2$ on increasing pressure and the pressure at which it deflects between $d_2$ and $d_1$ on decreasing pressure. The diaphragm whose trace is shown in FIG. 10 has a diameter of 0.400 inch, a thickness of 0.0050 inch, the total displacement of the diaphragm in a free condition, ie, without the presence of motion limiting means such as rivet 44, is approximately 0.012 inch and the deflection between $d_1$ and $d_2$ is 0.005 inch.

One of the advantages that using such a diaphragm offers is that placement of the contact surface 46 is much less critical to obtain operation at a selected pressure level since the contact surface need only be placed anywhere on the longitudinal axis of rivet 44 which intersects the center of diaphragm 60 measured from a plane on which the outer periphery of diaphragm 60 lies within deflections $d_1$ and $d_2$, or as indicated in FIG. 10, within 0.005 inch. However, in order to obtain maximum benefit for continued operation at the calibrated pressure level the contact it is preferred to place the contact on the $d_1$ side of the $d_1$–$d_2$ range to allow for contact wear.

Suitable diaphragms having a differential of 20% or less of actuation pressure but preferably 5% or less have been found to exceed 25 million cycles. Thus for a diaphragm adapted to actuate at a pressure of approximately 22 psi a differential of 4 psi and preferably as little as 1 psi can provide adequate longevity for many applications.

Diaphragms made for a switching assembly made in accordance with this invention were formed of a sheet of stainless steel 0.0050 inch thick with a diameter of 0.400 inch. The diaphragm was formed so that center portion 60 displacement "d" was 0.012 inch. This resulted in a deflection of $d_1$–$d_2$ of 0.005 inch at a pressure of 22 psig if unrestrained by a center contact. The radius of the convex surface of rivet 44 was 0.130 inch with the surface reaching a height of 0.0015 inch over circular head 48.

Different values of set point pressures (that pressure corresponding to $d_1$ and $d_2$) can be obtained by using a different thickness for the diaphragm 54, different heat treatments, different material or by modifying the form of the die sets used in shaping the center portion.

It will be recognized that various modifications of the embodiments disclosed are possible within the scope of the invention claimed. For example diaphragms made in accordance with the invention can be used to sense force as well as pressure and can be composed of bimetal to sense temperature changes if so desired.

What is claimed:

1. An electric switch having an electrically insulative base, the base having a bottom wall and a side wall extending from the bottom wall defining a switch chamber, an electrical contact member disposed on the base member having at least a portion in the switch chamber, a dish shaped metallic diaphragm having an at rest convex surface configuration on a face thereof and having a circular outer peripheral edge engaging the electrical contact member and with the convex surface facing away from the base member, the center of the diaphragm having a pressure versus deflection relationship such that for increasing pressure from 0 psig up to and beyond a range of deflections between $d_1$ and $d_2$ the diaphragm has a relatively stiff effective spring rate with the center deflecting between $d_1$ and $d_2$ at essentially the same pressure, the diaphragm also having a relatively narrow differential between the pressure at which the center of the diaphragm deflects between $d_1$ and $d_2$ on increasing pressure and the pressure at which it deflects between $d_2$ and $d_1$ on decreasing pressure, means to place a fluid pressure source in communication with the said face of the diaphragm and an electrically conductive center contact member mounted in alignment with the center of the diaphragm between $d_1$ and $d_2$ from a plane on which the outer peripheral edge of the diaphragm lies.

2. An electric switch according to claim 1 in which the differential between the pressure at which the center of the diaphragm deflects between $d_1$ and $d_2$ on increasing pressure and the pressure at which it deflects between $d_2$ and $d_1$ on decreasing pressure is equal to or less than approximately 5 psi.

3. An electric switch according to claim 2 in which the differential is equal to or less than approximately 3 psi.

4. An electric switch according to claim 1 in which the bottom wall is formed with a bore aligned with the center of the diaphragm and the electric contact member is a rivet having a circular flanged head, the circular flanged head being countersunk in the bottom wall so that a smooth surface is disposed in the path of the diaphragm when the said face moves from its convex configuration to thereby mitigate stresses formed in the diaphragm as the center of the diaphragm engages the electrical contact member.

5. An electric switch according to claim 4 in which the circular flanged head is formed with a centrally disposed convex surface facing the diaphragm circumscribed by an outer flat ring portion.

6. An electric switch according to claim 5 in which the diaphragm has an outer diameter of approximately 0.400 inch and the central convex surface of the electric contact member has a radius of approximately 0.130 inch.

7. An electric switch according to claim 6 in which the convex surface of the electric contact member extends approximately 0.0015 inch above the outer flat ring.

8. An electric switch according to claim 7 in which the distance between $d_1$ and $d_2$ is approximately 0.005 inch.

* * * * *